US009321148B2

(12) United States Patent
Huber

(10) Patent No.: US 9,321,148 B2
(45) Date of Patent: Apr. 26, 2016

(54) ABRASIVE CUT-OFF WHEEL

(75) Inventor: Johann Huber, Kramsach (AT)

(73) Assignee: TYROLIT—SCHLEIFMITTELWERKE SWAROVSKI K.G., Schwaz (AT)

( * ) Notice: Subject to any disclaimer, the term of this patent is extended or adjusted under 35 U.S.C. 154(b) by 326 days.

(21) Appl. No.: 14/128,795

(22) PCT Filed: Mar. 27, 2012

(86) PCT No.: PCT/AT2012/000080

§ 371 (c)(1),
(2), (4) Date: Feb. 26, 2014

(87) PCT Pub. No.: WO2012/129584

PCT Pub. Date: Oct. 4, 2012

(65) Prior Publication Data

US 2014/0162539 A1 Jun. 12, 2014

(30) Foreign Application Priority Data

Mar. 30, 2011 (AT) ..... A 446/2011

(51) Int. Cl.
*B24D 5/12* (2006.01)
*B24D 5/16* (2006.01)

(52) U.S. Cl.
CPC ... *B24D 5/12* (2013.01); *B24D 5/16* (2013.01)

(58) Field of Classification Search
CPC .... B23D 61/021; B23D 61/025; B24B 45/00; B24D 5/02; B24D 5/04; B24D 5/10; B24D 5/12; B24D 5/16; B28D 1/121
See application file for complete search history.

(56) References Cited

U.S. PATENT DOCUMENTS 2,508,946 A * 5/1950 Hoffman ..... B24D 5/16 451/342
2,735,243 A * 2/1956 Allison ..... B23D 61/026 451/544

(Continued)

FOREIGN PATENT DOCUMENTS

AT 338 130 8/1977
AT 502 285 2/2007

(Continued)

OTHER PUBLICATIONS

International Search Report issued Jul. 16, 2012 in International (PCT) Application No. PCT/AT2012/000080.

(Continued)

*Primary Examiner* — Timothy V Eley
(74) *Attorney, Agent, or Firm* — Wenderoth, Lind & Ponack, L.L.P.

(57) ABSTRACT

An abrasive cut-off wheel with an abrasive cut-off ring (1), the abrasive body (10) of which comprises bound abrasive, wherein the abrasive cut-off ring (1) is fixed in the operating state by means of two circular clamping discs (2, 3) that can be clamped together in axial direction by means of central clamping flanges (4*a*, 4*b*) on the machine side, and at least one clamping disc (2) is connected in an anti-twist manner to the abrasive cut-off ring (1) by means of interacting projections (5, 6) and recesses (7, 8), and wherein the projections (5) and recesses (7) respectively arranged on the abrasive cut-off ring (1) are provided on a metal insert (9) of the abrasive cut-off ring (1), which projects beyond the abrasive body (10) in radial direction.

7 Claims, 6 Drawing Sheets

(56) References Cited

U.S. PATENT DOCUMENTS

| | | | | |
|---|---|---|---|---|
| 3,256,646 | A | 6/1966 | Mockli | |
| 5,516,326 | A * | 5/1996 | Virnich | B24D 5/16 451/340 |
| 6,071,185 | A | 6/2000 | Genau et al. | |
| 6,454,639 | B1 * | 9/2002 | Huber | B24B 45/00 451/342 |
| 7,115,029 | B2 | 10/2006 | Lang et al. | |
| 7,588,484 | B2 * | 9/2009 | Momosaki | B24D 5/16 451/359 |
| 8,113,920 | B2 | 2/2012 | Gissing | |

FOREIGN PATENT DOCUMENTS

| | | |
|---|---|---|
| DE | 202 20 516 | 11/2003 |
| EP | 0 909 612 | 4/1999 |

OTHER PUBLICATIONS

Austrian Search Report issued Nov. 18, 2011 in Austrian Patent Application No. A 446/2011 with English translation.

* cited by examiner

A (1 : 2)

B (1 : 2)

ABRASIVE CUT-OFF WHEEL

The invention concerns an abrasive cut-off wheel with an abrasive cut-off ring, the abrasive body of which comprises bound abrasive, wherein the abrasive cut-off ring is fixed in the operating state by means of two circular clamping discs that can be clamped together in axial direction by means of central clamping flanges on the machine side, and at least one clamping disc is connected in an anti-twist manner to the abrasive cut-off ring by means of interacting projections and recesses.

In known devices of that type (see AT 502 285), the clamping discs are connected with the abrasive cut-off ring in the area of the abrasive body. This requires providing it with positionally and dimensionally accurate indentations, which makes the moulding of the abrasive body more expensive if you want to forego a subsequent grinding of the indentations. At any rate, the provided introduction of the torque directly in the area of the abrasive cut-off ring that consists of bound abrasive limits the continuous load-bearing capacity at usual work speeds of 80 or 100 m/s.

The invention is based on the consideration that a permanent connection between the metal part of the device and the bound abrasive is less problematic than the connection of the clamping discs in the area of the bound abrasive provided according to the state of the art. Consequently the invention assumes a configuration of the abrasive cut-off ring as it is, for example, described in U.S. Pat. No. 3,256,646, i.e. an abrasive cut-off ring with a metal insert which is closely connected with the abrasive body. Such a connection is achieved, for example, by the fact that projections of the insert project into the abrasive body and that the material of the abrasive body penetrates openings in the insert.

In order to achieve the desired metal-metal connection, the invention suggests that the projections and recesses respectively on the side of the abrasive cut-off ring are provided on a metal insert of the abrasive cut-off ring which projects beyond the abrasive body in axial direction.

Abrasive cut-off wheels according to the invention are especially designed for stationary use on machinery for cutting hard work pieces. These cut-off wheels are used from outside diameters of approx. 1250 mm, mainly in the steel industry, in order to cut casts (slabs) during ongoing production. A cutting gap according to the total thickness of the cut-off wheel is produced in the slab. Depending on the diameter of the slab, the cutting process is realised with one cut or several cuts, while the cast has to be rotated several times in axial direction in the process. Larger cut-off wheel diameters enable, on the one hand, a cutting process with one cut, but they used to require thicker cut-off wheels to ensure stability and stiffness and to absorb the lateral loads that develop. The disadvantage of thicker discs is a wider cutting gap and consequently more waste.

Now the invention enables, on the one hand, larger disc diameters, and on the other hand, the disc thickness that is necessary for reasons of stability is reduced with the given diameter. Together with the disc thickness, however, the cutting gap is reduced and waste of material and energy consumption in proportion to that.

Preferably the insert provided in the abrasive cut-off ring does not only ensure a tight fit between the clamping disc(s) and the abrasive cut-off ring, but also the force fit produced by the clamping discs. In this sense, it is planned that the abrasive cut-off ring is only compressed in the area of the insert of the clamping discs and that there is a gap between the clamping discs and the abrasive body.

Surprisingly it was found that the vibration behaviour of the device improves when the frictional connection between clamping discs and insert is realised completely evenly across the entire circumference, which can be achieved by placing the clamping discs at a distance from the insert in axial direction in the area of the projections of the insert. Even the entire inner edge of the insert can be positioned at a small distance from the clamping discs.

BRIEF DESCRIPTION OF THE DRAWINGS

Further details of the invention are illustrated below with the aid of the drawings. There

DETAILED DESCRIPTION OF THE INVENTION

Figure 1:
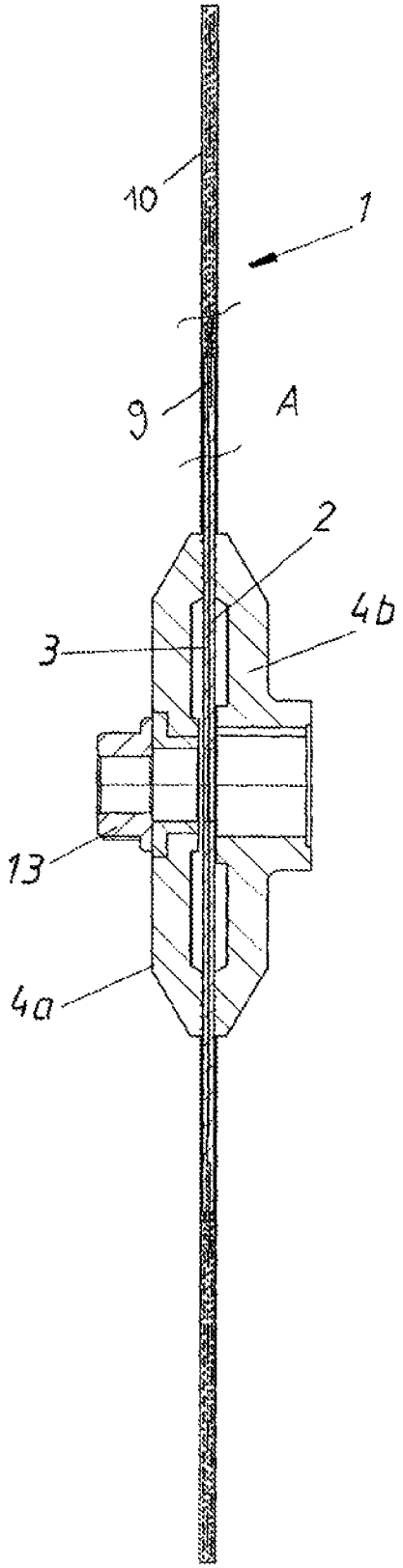
FIG. 1 shows the cross-section of an abrasive cut-off wheel.

The abrasive cut-off wheel shown in FIG. 1 mainly consists of an abrasive cut-off ring 1, which is held by two circular clamping discs 2 and 3 in the operating state. These are again clamped together by means of two central clamping flanges 4*a* and 4*b* on the machine side, which are screwed and fixed with a nut 13.

Figure 3:
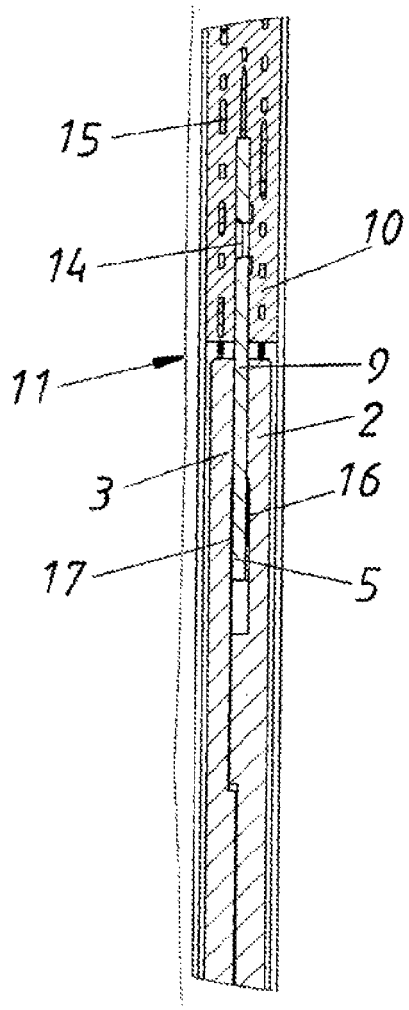
FIG. 3 shows an enlarged detail of FIG. 1.

FIG. 3 first shows a clear view of the abrasive cut-off ring 1. It has an abrasive body 10, which is constituted by several layers of abrasive grain, binder and fillers. Between the individual abrasive grain layers, there are tissue layers 15 for reinforcement. Abrasive body 10 has a thickness that increases in the direction to the outer edge. This thickness can increase, for example, with an outer disc diameter of 1250 mm from 10 mm to 12 mm from the inner to the outer edge. This prevents abrasive cut-off ring 1 from getting caught in the cutting gap during use.

Relevant for the invention is insert 9 in the abrasive body 10, which can be made, for example, out of steel. In this insert 9, there are alternately oriented openings (notches) 14, the curved edges of which protrude in the material of the abrasive body 10 and penetrate adjacent tissue layers 15. Consequently, there is a strong, permanent connection between insert 9 and the abrasive body 10.

The insert 9 projects beyond the abrasive body 10 in the direction of the centre of the abrasive cut-off ring 1. The projecting edge has projections 5 and recesses 7 in between.

The abrasive cut-off ring 1 is held by clamping discs 2 and 3 exclusively in the projecting area of the insert 9. Consequently, there is at least a small gap 11 between the abrasive body 10 and the clamping discs 2 and 3.

As can be seen in FIG. 3, no clamping of the insert 9 by means of the clamping discs 2 and 3 is provided in the area of the projections 5 of the insert 9 in the shown embodiment. On the contrary, there is a minor clearance 16 or 17 in axial direction of the abrasive cut-off wheel between the projections 5 and the clamping discs 2 or 3. The clearance is, for example, 0.2 mm.

Figure 4:
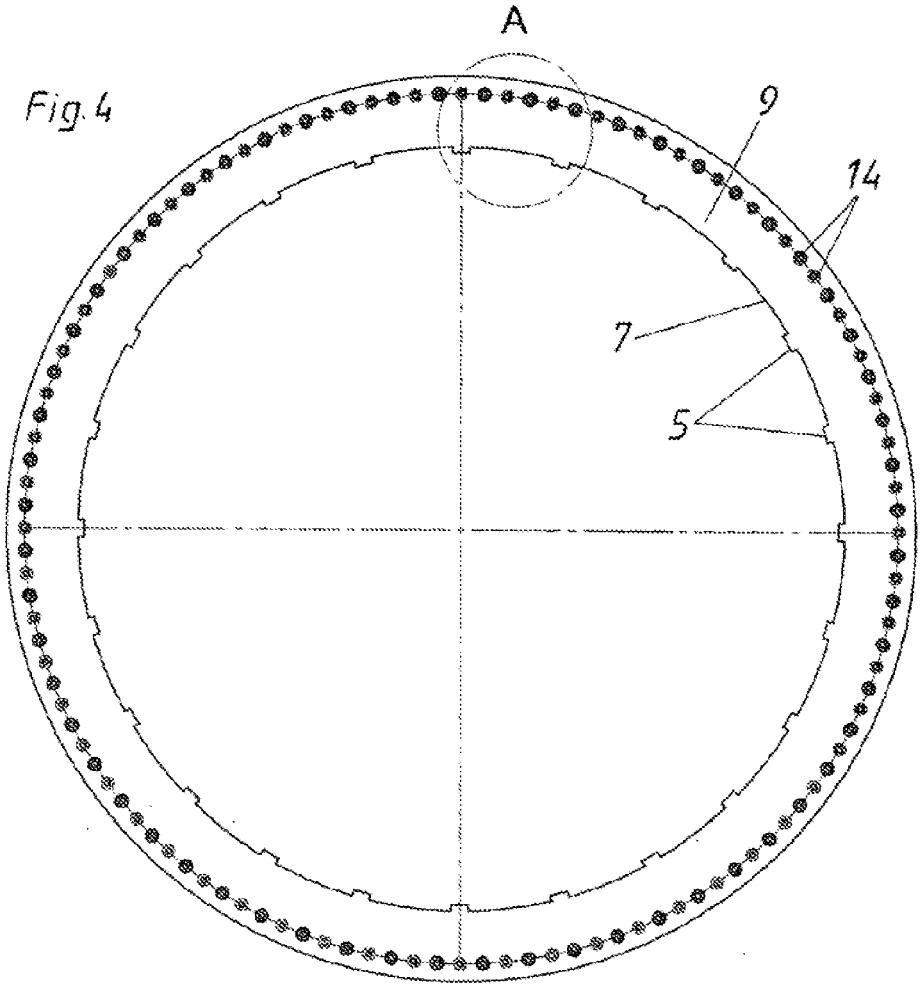
FIG. 4 shows a view of insert 9.
Figure 5:
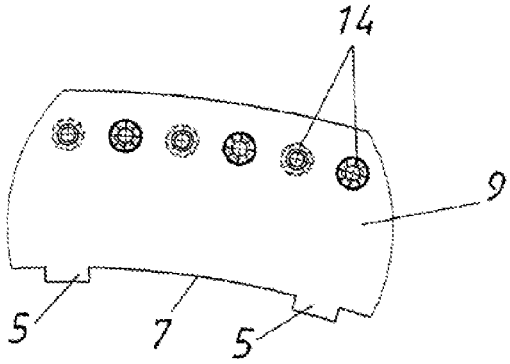
FIG. 5 shows an enlarged detail of FIG. 4.

In order to explain the form-closed connection of the abrasive cut-off ring 1 with the clamping discs 2, 3 which is essential for the invention in more detail, FIGS. 4 and 5 first show the insert 9 of the abrasive cut-off ring 1 with its inside projections 5 and the recesses 7 in between.

Figure 6:
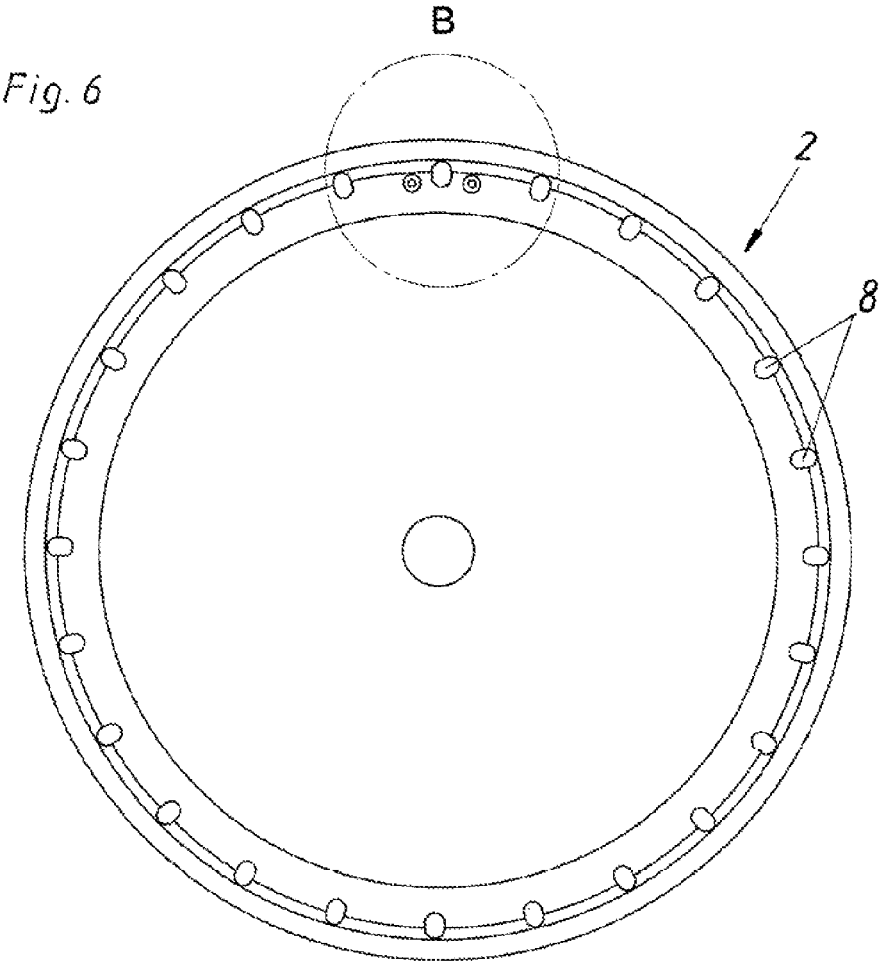
FIG. 6 shows a view of clamping disc 2.
Figure 7:
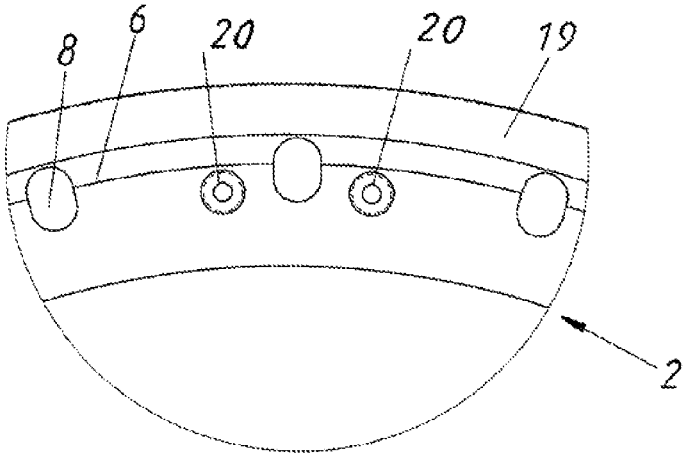
FIG. 7 shows an enlarged detail of FIG. 6.
Figure 8:
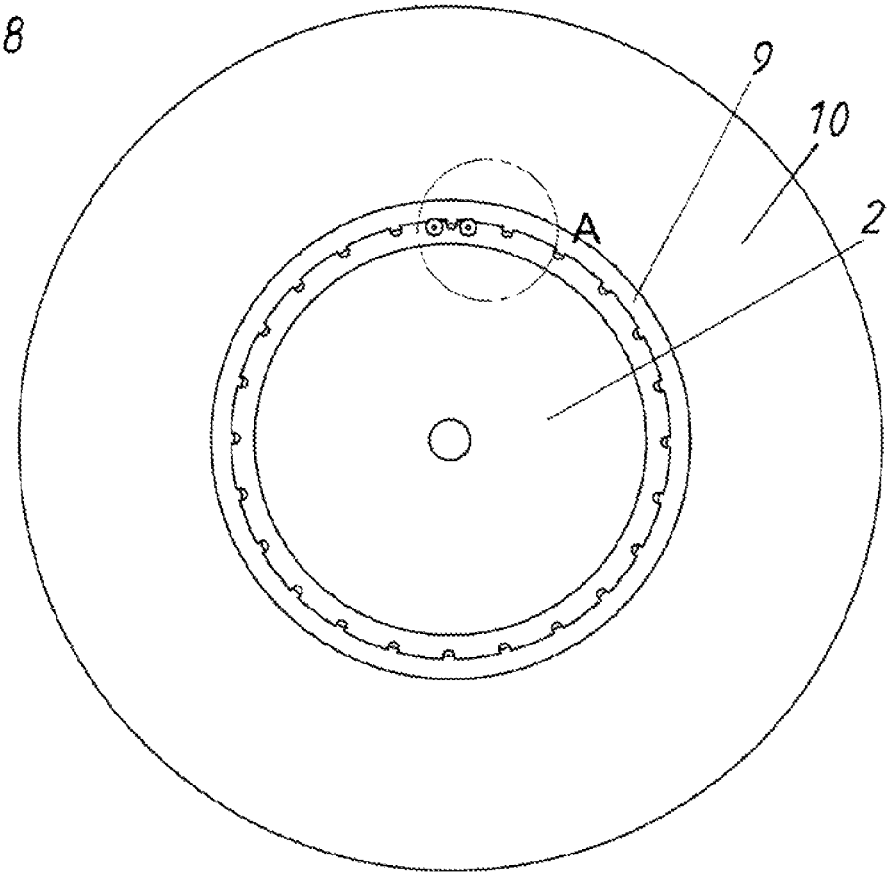
FIG. 8 shows a view of the abrasive cut-off ring 1 placed on clamping disc 2.
Figure 9:
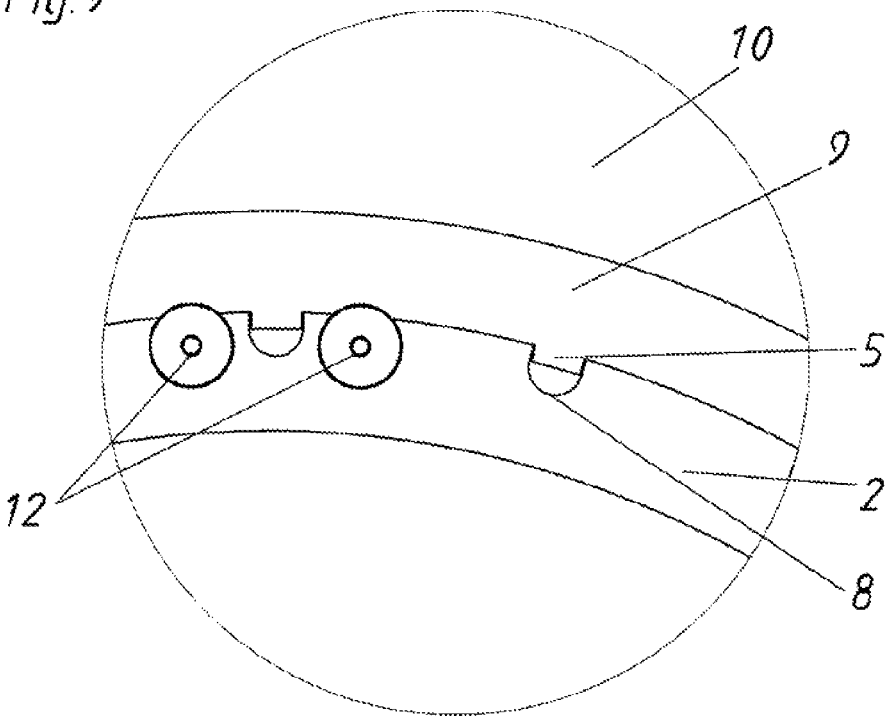
FIG. 9 shows an enlarged detail of FIG. 8.

When mounting the abrasive cut-off wheel, first clamping flange 4*b* and then clamping disc 2 shown in FIGS. 6 and 7 are slid on the machine shaft. In the area of the edge 19 of the clamping disc 2, there are milled recesses 8 in which the projections 5 of the abrasive cut-off ring 1 engage later. The retaining flanges 12 inserted and screwed in borings 20 project beyond the clamping disc 2 in such a way that the abrasive cut-off ring 1 can be mounted behind these ends. How this is done can be gathered in detail from FIGS. 8 and 9. In particular, it has to be made sure that the retaining flanges 12 of the clamping disc 2 have been positioned at the highest point in order to prevent slipping of the insert 9 of the abrasive cut-off ring 1.

Figure 2:
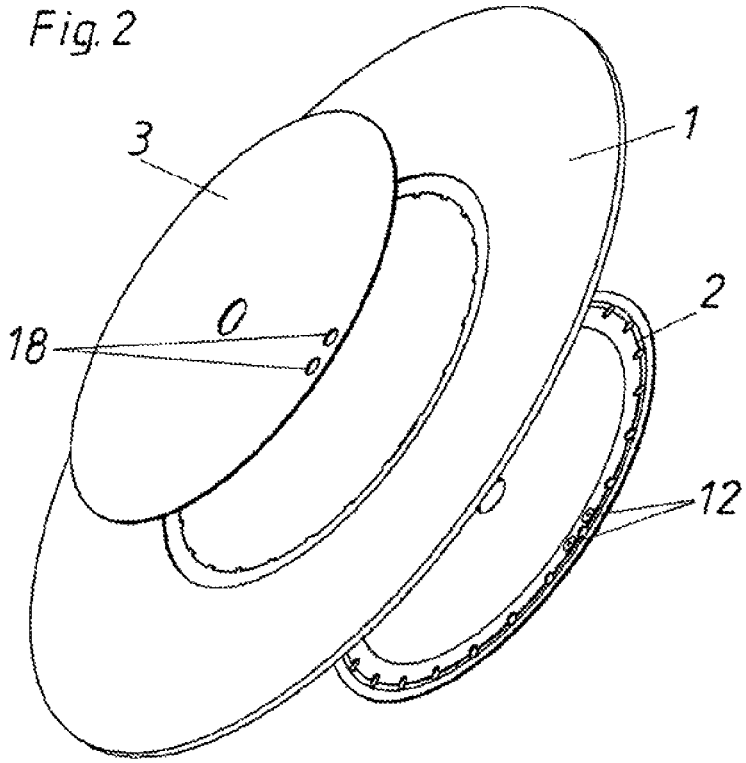
FIG. 2 shows an illustration of the main parts of FIG. 1.

In order to complete assembly, only the clamping disc 3 remains to be positioned, with the borings 18 in the clamping disc 3 (see FIG. 2) receiving the retaining flanges 12. Naturally the clamping flange 4*a* and the nut 13 still have to be fixed too.

A major advantage of the illustrated structure is that only the insert 9 and the remainder of the abrasive body 10 that surrounds this insert have to be disposed of, and the abrasive body in the area of the insert can even be made of more cost-efficient abrasive grain. On the other hand, an essential part of the entire device remains with the user with the clamping discs 2 and 3. In the face of this advantage, the effort necessary for the fixing of abrasive cut-off ring 1 on the clamping discs is negligible.

Figure 10:
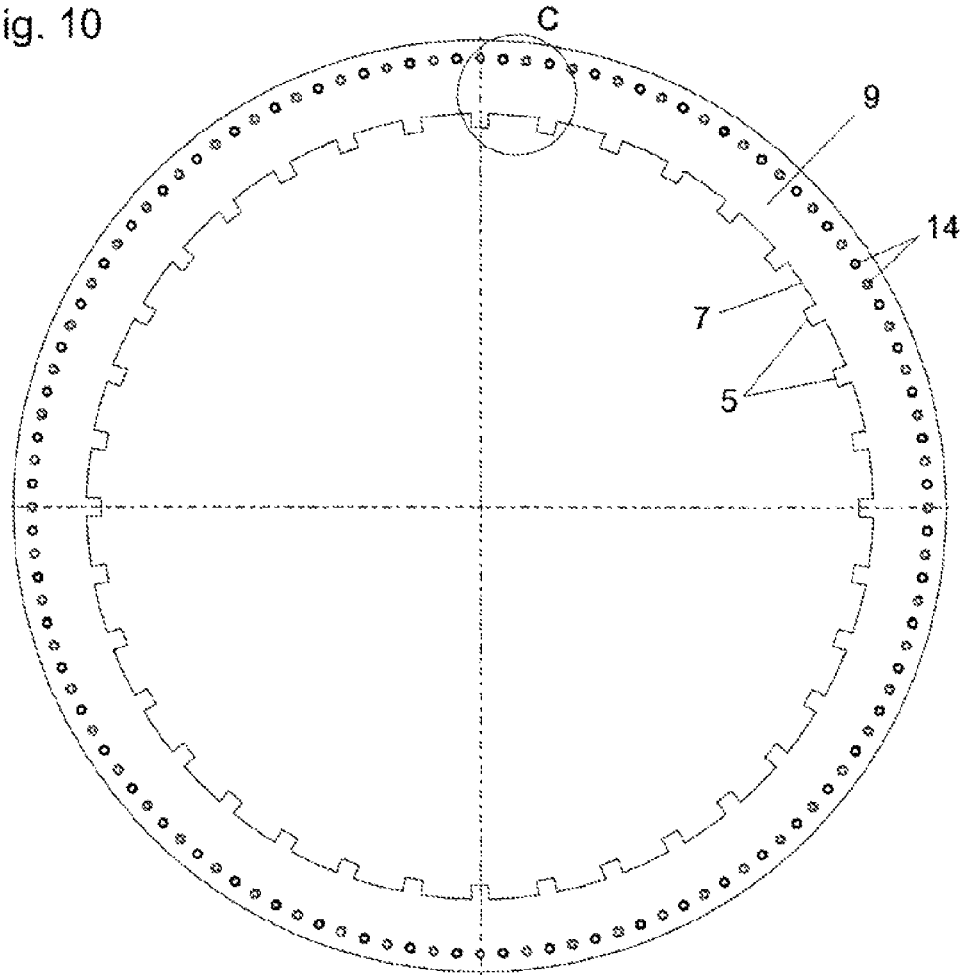
FIG. 10 shows a view of a modified insert 9.
Figure 11:
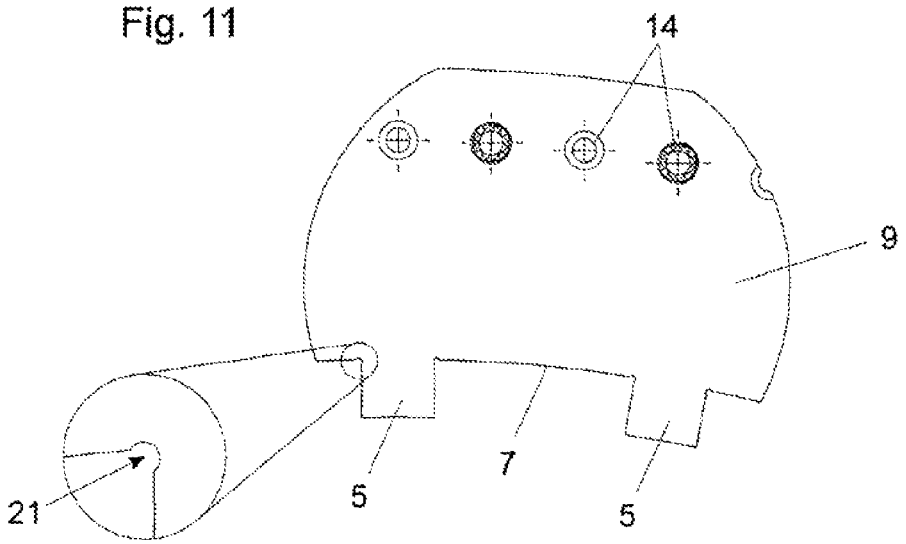
FIG. 11 shows an enlarged detail from FIG. 10.

FIGS. 10 and 11 show a modified embodiment of the metal insert 9, with FIG. 11 showing an enlarged detail of FIG. 10. Compared to the embodiment shown in FIG. 4, the metal insert 9 shown in FIGS. 10 and 11 has clearly more projections 5. The length of the projections 5 in radial direction is furthermore approx. 2 to 3 times as large. And finally 9 notch-shaped recesses 21 are provided in the transition areas between the projections 5 and the recesses 7 of the metal insert. In this connection, an expert refers to such recesses also as undercuts. On principle, the recesses 21 can have—seen in the axial direction in the cross-section—different shapes. In the case of the embodiment in FIGS. 10 and 11, the notch-shaped recesses 21 are for the most part semi-circular. The three described measures contribute to further increasing the resistance of the form-closed connection between the clamping discs and the abrasive cut-off ring to deformation and wear and tear, such as the formation of cracks in the corners between the projections 5 and the recesses 7.

The invention claimed is:

1. An abrasive cut-off wheel with an abrasive cut-off ring, the abrasive cut-off ring having an abrasive body which comprises bound abrasive, wherein the abrasive cut-off ring is fixed in an operating state by means of two circular clamping discs that can be clamped together in an axial direction by means of central clamping flanges on a machine side, and at least one clamping disc is connected in an anti-twist manner to the abrasive cut-off ring by means of interacting projections and recesses, wherein the projections and recesses respectively arranged on the abrasive cut-off ring are provided on a metal insert of the abrasive cut-off ring, the metal insert projecting beyond the abrasive body in a radial direction.

2. The abrasive cut-off wheel according to claim 1, wherein the recesses penetrate an entire thickness of the insert.

3. The abrasive cut-off wheel according to claim 1, wherein the abrasive cut-off ring is only compressed by the clamping discs in an area of the insert.

4. The abrasive cut-off wheel according to claim 3, wherein there is a gap between the clamping discs and the abrasive body.

5. The abrasive cut-off wheel according to claim 1, wherein in an area of the projections of the insert, the clamping discs are positioned at a distance from the insert in the axial direction.

6. The abrasive cut-off wheel according to claim 1, wherein for reciprocal alignment of the abrasive cut-off ring and the clamping flanges, two retaining flanges on a clamping flange are provided.

7. The abrasive cut-off wheel according to claim 1, wherein notch-shaped recesses are provided in transition areas between the projections and the recesses of the metal insert.

* * * * *